US005794870A

United States Patent [19]

Langlie

[11] Patent Number: 5,794,870

[45] Date of Patent: Aug. 18, 1998

[54] BAG RE-ROLLING APPARATUS

[75] Inventor: Ronald H. Langlie, Ellendale, Minn.

[73] Assignee: North Central Plastics, Ellendale, Minn.

[21] Appl. No.: 773,487

[22] Filed: Dec. 23, 1996

[51] Int. Cl.[6] ..... B65H 18/10

[52] U.S. Cl. ..... 242/538.2

[58] Field of Search ..... 242/538, 538.1, 242/538.2, 538.3, 539, 530, 531

[56] References Cited

U.S. PATENT DOCUMENTS

| | | | |
|---|---|---|---|
| 474,904 | 5/1892 | Cruzan | 242/538.2 |
| 1,253,372 | 1/1918 | Gotti | 242/531 |
| 2,261,555 | 11/1941 | Luehrs . | |
| 3,266,745 | 8/1966 | Benson . | |
| 3,312,409 | 4/1967 | Hurley | 242/531 |
| 3,501,109 | 3/1970 | Edson | 242/538 |
| 3,525,479 | 8/1970 | Stobi . | |
| 3,527,426 | 9/1970 | Morrow | 242/538 |
| 3,782,666 | 1/1974 | Sandrone et al. | 242/538.3 |
| 3,845,915 | 11/1974 | Schmidt et al. | 242/530 |
| 5,194,062 | 3/1993 | Membrino . | |
| 5,301,883 | 4/1994 | Lukaart . | |

*Primary Examiner*—John M. Jillions
*Attorney, Agent, or Firm*—Merchant, Gould, Smith, Edell, Welter & Schmidt

[57] ABSTRACT

An apparatus for re-rolling a web of plastic bags that has been printed includes first, second and third spindles mounted on a frame. The web from the printer is collected on a spool on the first spindle. This spool with the web is then transferred to the second spindle and then the web from the second spindle is rolled onto the third spindle so that the bags are presented in the proper orientation for subsequent handling such as in a manual bagging operation. The first and third spindles are driven, for examples with separate electric motors.

9 Claims, 2 Drawing Sheets

BAG RE-ROLLING APPARATUS

BACKGROUND OF THE INVENTION

The present invention is directed to an apparatus for re-rolling a web of bags, particularly a web of bags that has been printed. The present apparatus facilitates the use of a printer associated with automatic bagging operations for hand-bagging processes.

Automated bagging operations currently are available for packaging various types of goods in plastic bags for retail sale. The automatic bagging apparatus can be programmed to handle a number of different types of pieces. Typically, the pieces will be relatively small, for example occupying a volume less than about 12 cubic inches, and can be made of plastic, wood or similar materials. The bagging apparatus includes a printer for printing identifying information such as UPC codes, part numbers and the like on a web of otherwise identical bags that are being fed into the automatic bagging system.

However, for some businesses, it is not possible to package all of the types of pieces sold by the business with the automatic bagging system. For example, in a business such as the production of plastic pieces used in connection with wire fencing, while many of the pieces involved can be packaged with the automatic bagging system, some of the pieces are too large to be processed by the automatic bagging system, and the packaging of these parts must be carried out in a manual packaging system.

It would be desirable to utilize the printer associated with the automatic bagging system to print the bags to be used for the manual system. However, the handling of the bags after printing has been inconvenient.

SUMMARY OF THE INVENTION

The present invention provides an apparatus for handling a web, particularly a web in the form of a plurality of bags. The apparatus includes a frame having a first spindle and spool for collecting the web, a second spindle on the frame for accepting the spool from the first spindle and a third spindle carrying a spool for rolling the web from the second spindle. The apparatus also includes a driver for rotating the first and third spindles, and in particular it is desired to provide a separate driver for the first spindle and the third spindle. The present invention permits the convenient collection of the web from a printer, and allows the re-rolling of the web so that it assumes the proper orientation for use in subsequent operations such as a manual-type bagging operation.

DETAILED DESCRIPTION

Figure 1:
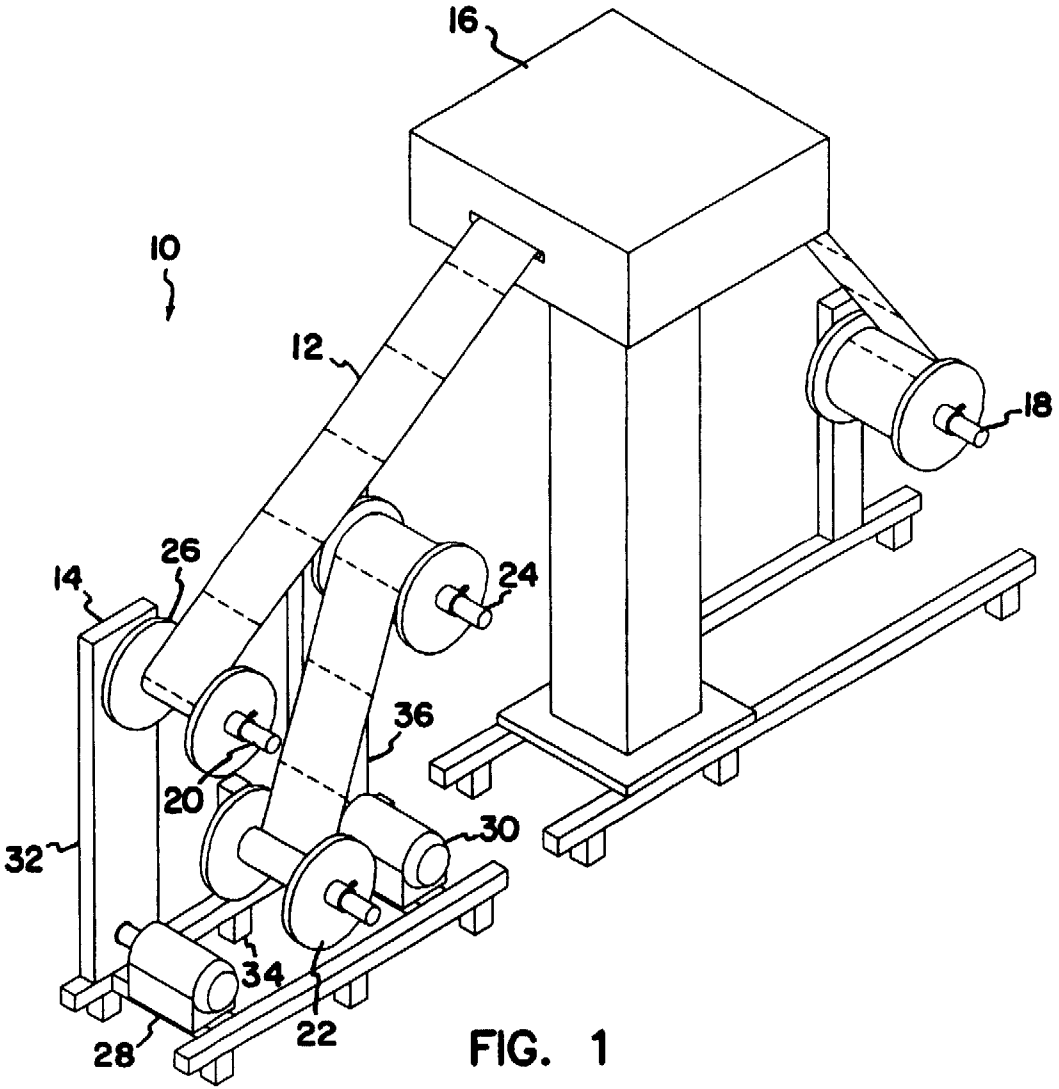
FIG. 1 is a perspective view of an apparatus according to the present invention.
Figure 2:
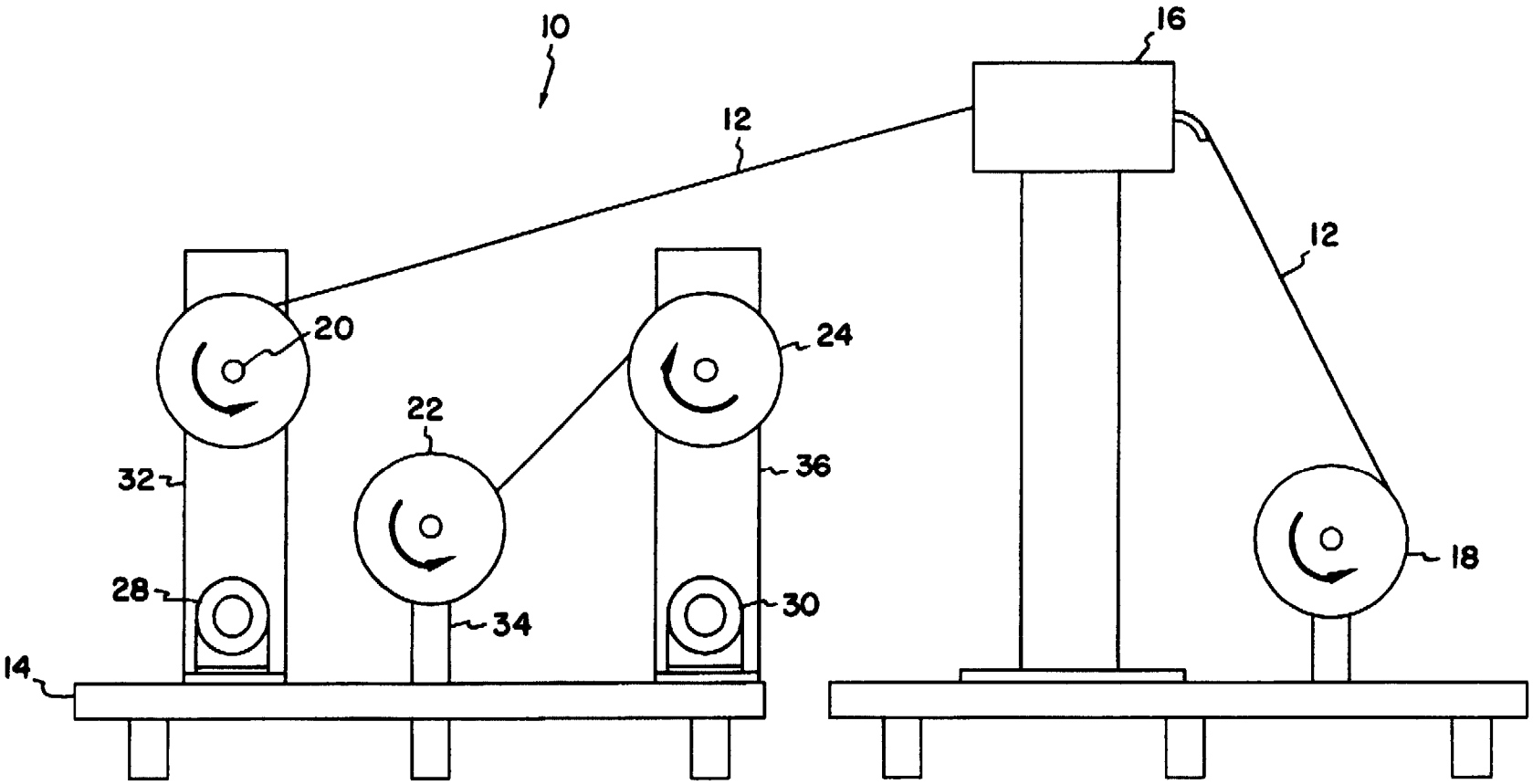
FIG. 2 is a side view of the apparatus of FIG. 1.

Referring to the Figures, the web re-rolling apparatus 10 of the present invention is positioned to receive a web 12 after it has been printed by printer 16. The present invention is particularly useful in handling a web of plastic bags to be used for the packaging of pieces for retail sale.

Ordinarily, the printer 16 would be associated with an automatic bagging apparatus. Thus, the unprinted bags on spindle 18 of the printer would be passed through the printer 16 and then directly to an automatic bagging apparatus. The present invention facilitates the use of the printer with a bagging operation, e.g. that does not use the automatic bagging apparatus, e.g. a manual process. It should be noted that the term manual is used to denote an operation that requires some operator assistance as distinguished from the fully automated system, but it should not be interpreted as suggesting that no machinery is involved.

The apparatus 10 of the present invention includes a frame 14 having first, second and third vertical members 32, 34 and 36. First, second and third spindles 20, 22 and 24 are carried on the frame, preferably one for each vertical member.

After printing, rather than being delivered to the automatic bagging apparatus, the web 12 is collected on a spool 26 carried by the first spindle 20. The spindle 20 is driven, for example by an electric motor 28 that is carried on the frame.

When the desired printed web has been collected on spool 26, the spool is removed from spindle 20 and transferred to second spindle 22. The end of the web is then secured to a spool on spindle 24, and spindle 24 then is driven to re-roll the web. When the re-rolling is finished, the spool on spindle 24 can be removed and taken to the desired location for use in the manual bagging operation. The bags will be printed and will be carried on the spindle in the proper orientation for the subsequent operations. It is preferred that a separate drive be provided for the third spindle 24, e.g. a second electric motor 30 that is carried on the frame. However, it would be possible to drive both spindle 20 and spindle 24 from the same power source, with a clutch mechanism permitting the selective engagement of either spindle with the power source.

While a detailed description of the present invention has been provided above, the present invention is not limited thereto and modifications within the scope and spirit of the invention will be apparent to those skilled in the art. The invention is defined by the following claims.

What is claimed is:

1. A web re-rolling apparatus, comprising:

a frame;

a first spindle on the frame for rolling a web onto a first spool;

a second spindle on the frame for accepting the first spool onto which the web has been rolled, said second spindle and said first spool being rotatable in a first direction;

a third spindle on the frame for rolling the web from the second spindle onto a second spool, said third spindle and said second spool being rotatable in a second direction opposite said first direction;

wherein the first and third spindles are motor-driven.

2. The web re-rolling apparatus of claim 1, further comprising a first motor for rotating the first spindle and a second motor for rotating the third spindle.

3. The web re-rolling apparatus of claim 2, wherein the second spindle is not driven.

4. The web re-rolling apparatus of claim 1, wherein the frame comprises a base member and a plurality of vertical members extending outwardly from the base member for supporting the first, second and third spindles.

5. The web re-rolling apparatus of claim 1, wherein the web supplied to the first spindle is received from a printer.

6. The web re-rolling apparatus of claim 5, wherein the web comprises a plurality of plastic bags.

7. The web re-rolling apparatus of claim 6, wherein the printer is a component of an apparatus for printing and automatically filling plastic bags.

8. A web re-rolling apparatus, comprising:

a frame;

a first spindle on the frame for rolling a web of plastic bags onto a first spool from a printer, wherein the web of plastic bags after rolling onto the first spool has a first orientation;

a second spindle on the frame for accepting the first spool onto which the web of plastic bags has been rolled, said second spindle being rotatable in a first direction;

a third spindle on the frame for rolling the web from the second spindle onto the third spindle, said third spindle being rotatable in a second direction opposite said first direction, whereby the web of plastic bags rolled onto the third spindle has a second orientation opposite from the first orientation;

a first driver for rotating the first spindle; and a second driver for rotating the third spindle.

9. The web re-rolling apparatus of claim 8, wherein the web is generally planar and includes first and second opposite sides, and wherein in the first orientation of the rolled web the first side faces outwardly and in the second orientation the second side faces outwardly.

* * * * *